US007407067B2

(12) United States Patent
Kerkhof et al.

(10) Patent No.: US 7,407,067 B2
(45) Date of Patent: Aug. 5, 2008

(54) POURER

(75) Inventors: Patrick Lambertus Kerkhof, Zoetermeer (NL); Eelco Jan Gerardus Witteveen, Schiedam (NL); Arnoldus Willem Zweekhorst, Delfgauw (NL)

(73) Assignee: Vacu Vin Innovations Ltd., Gibraltar (GB)

( * ) Notice: Subject to any disclaimer, the term of this patent is extended or adjusted under 35 U.S.C. 154(b) by 378 days.

(21) Appl. No.: 10/541,235

(22) PCT Filed: Jan. 5, 2004

(86) PCT No.: PCT/NL2004/000001

§ 371 (c)(1),
(2), (4) Date: Jul. 1, 2005

(87) PCT Pub. No.: WO2004/060752

PCT Pub. Date: Jul. 22, 2004

(65) Prior Publication Data

US 2006/0081649 A1 Apr. 20, 2006

(30) Foreign Application Priority Data

Jan. 2, 2003 (NL) ..... 1022297

(51) Int. Cl.
*B67D 1/16* (2006.01)

(52) U.S. Cl. ..... 222/109; 222/569; 222/571

(58) Field of Classification Search ..... 222/109, 222/108, 111, 566, 569, 571; *B65D 23/06*
See application file for complete search history.

(56) References Cited

U.S. PATENT DOCUMENTS

| | | | | |
|---|---|---|---|---|
| 2,736,447 | A * | 2/1956 | De Brock | 222/571 |
| 2,743,844 | A * | 5/1956 | Livingston | 222/111 |
| 2,889,080 | A * | 6/1959 | Livingstone | 222/109 |
| 4,298,145 | A * | 11/1981 | Iida | 222/478 |
| 5,101,993 | A * | 4/1992 | Nairn et al. | 215/232 |
| 5,941,422 | A * | 8/1999 | Struble | 222/109 |

FOREIGN PATENT DOCUMENTS

| | | |
|---|---|---|
| FR | 559597 | 9/1923 |
| FR | 622696 | 6/1927 |
| FR | 1198362 | 12/1959 |

* cited by examiner

*Primary Examiner*—Kevin P. Shaver
*Assistant Examiner*—Hyea J Choi
(74) *Attorney, Agent, or Firm*—Sughrue Mion, PLLC

(57) ABSTRACT

Pourer consisting of an elongated, tubular part of plastic material. This part of plastic material is made resilient and has an external diameter greater than that of the associated bottles. The tubular part is provided with a split, as a result of which the diameter can be reduced to some extent and the pourer can be accommodated with a clamping action in a bottle. This clamping can be even further promoted by providing ribs. The pourer is provided with a search point to facilitate introduction into a bottle and the pouring end is flared.

14 Claims, 3 Drawing Sheets

POURER

BACKGROUND OF THE INVENTION

The present invention relates to a pourer, comprising a sleeve-shaped elongated body constructed at one end for introduction into the pouring facility of a container with a tight fit and constructed at the other end as a collector for liquid droplets, wherein a pouring section is arranged in said other end, the free end of said pouring section in the pouring position protruding further than the free end of the collector, wherein a collection channel is delimited between said collector and said pouring section, said collection channel having a transverse section extending transversely with respect to the longitudinal axis of said elongated body and merging into a longitudinal section on either side.

A pourer of this type is disclosed in FR 622 696 and FR 559 597. In both cases the pourer is designed to be fitted on the neck of a bottle. Although the present invention also relates to a pourer to be fitted on the neck of a bottle, it must be understood that this pourer can also be used with any other container that is provided with a pouring facility, such a tea- or coffee-pot.

In the construction according to the abovementioned publications, a channel extending essentially in the shape of a ring is arranged around the pouring section. This ring is arranged somewhat inclined with respect to the longitudinal axis of the pourer and at the lowest point there is a join to the sleeve-shaped section. When the bottle is placed upright any droplets move along the ring/circular channel towards the lowest point thereof and there flow into the sleeve-shaped section and thus move back into the bottle. It has been found that it cannot be guaranteed under all circumstances that such a return flow takes place in the optimum manner. In particular, spillage has been observed when the bottle is abruptly brought upright.

SUMMARY OF THE INVENTION

The aim of the present invention is to provide a pourer with which the return flow of collected droplets of liquid to the interior of the container is better controlled.

This aim is realised with a pourer described above in that the longitudinal section of the collection channel opens into the sleeve-shaped body.

According to the invention the channel is no longer constructed as a ring extending at an inclination with respect to the longitudinal axis of the pourer. According to the present invention this channel consists of a transverse section where, in particular, the initial collection of any liquid droplets takes place. Adjoining this there are longitudinal sections on either side of the transverse section. These longitudinal sections extend essentially parallel to the longitudinal axis of the pourer. This applies in particular in respect of the end part of the longitudinal section that opens into the interior of the sleeve-shaped section essentially parallel to the longitudinal axis of the pourer. In this way a well-channelled flow of the liquid droplets back into the container takes place and no change in the direction of flow has to take place at the location of the transition from the channel to the sleeve-shaped section, as was necessary in the state of the art.

According to an advantageous embodiment of the invention, the collector and pouring section are made of a single material and more particularly a plastic.

The channel according to the present invention preferably has a cross-section that gradually decreases from the collection point, that is to say the transverse section, to the end of the longitudinal section. According to an advantageous embodiment of the invention, this decrease is achieved in that the raised edge of the pouring section, which edge protrudes with respect to the collector, becomes increasingly shallower.

According to an advantageous embodiment of the invention the outer part of the second free extremity is at an angle to the longitudinal axis of the pourer, which angle is positive. By this means a droplet on top of the second free extremity is prevented from reaching the underside thereof when the bottle is in the horizontal position. This provides a further guarantee to prevent droplets moving back over the free end of the pouring section along the outside when a bottle provided with the pourer according to the invention is moved from the horizontal position into the vertical position.

According to a further variant of the present invention the seal between the pourer and the bottle is improved. Moreover, provision is made that bottles of different sizes can be accommodated. In general, constructions to provide fitting in different bottle necks are known. For instance, according to European application 870 694 a pourer is provided close to the clamping end with a number of slots extending in the longitudinal direction (longitudinal axis of the bottle). However, because the exterior of different bottles and more particularly the bottle neck varies appreciably, the device can as a result be used only with a limited number of standardised bottles.

A further aim of the present invention is to provide a pourer which provides a good seal between the pourer and the bottle and, moreover, can be used for a wide range of bottles.

This further aim is realised with a device described above in that the other end of said tubular body has an annular part provided with a split extending in the longitudinal direction of said body over the entire length thereof, which annular part is made of a resilient material.

According to this further embodiment of the present invention, the pourer, and more particularly the clamping means thereof, is accommodated in the interior of the bottle. It has been found that the interior of a bottle neck varies appreciably less than the exterior of a bottle neck for a wide variety of bottle types.

Furthermore, according to the invention it is proposed to provide the pouring body with a split that extends over the entire length thereof. As a result it is possible to provide an appreciable resilient force over a relatively wide range of diameters, so that sealing between the pourer and the interior of the neck of a bottle is guaranteed.

This split can be made such that material of the pourer is made to overlap and slides over itself when a pinching force is applied.

According to an advantageous variant of the invention, however, the split comprises a gap that in the unstressed state extends over at least 20 degrees. That is to say the pourer according to the invention is no longer a tube closed like a ring but a part of a tube.

It has been found that optimum clamping in the bottles can be obtained if the external diameter of the clamping part, that is to say the section that has to be introduced into the bottle, in the non-stressed state is at least the diameter of the largest bottle in which this is used (approximately 20 mm). With such a size it is possible to grip onto virtually all bottles known in the state of the art to produce a fit.

Complete engagement and sealing can be yet further improved if the annular part is provided with peripheral ribs. It has been found that in many bottles there is an increase in the diameter in the interior of the neck close to the free end. As a result of providing ribs, this part of enlarged diameter is gripped and optimum sealing and positioning of the pourer according to the invention can be provided.

According to the present invention introduction into the bottle or other container can be facilitated in that the end section that has to be introduced into the bottle or container is provided with a pointed end. By this means it is easy to enter the bottle and the clamping means are activated by simply pushing further, that is to say the pourer is compressed. This can be facilitated if the end limit of the pourer extends in the shape of a spiral (viewed along the longitudinal axis of the pourer) from this pointed end.

According to an advantageous embodiment of the invention, the other end of the pourer, that is to say the actual pouring section, is made to flare towards the pouring end. Preferably, this is part of an arc, the radius of which continually further increases towards the pouring end. In addition, the number of degrees spanned by the section of the circle decreases.

The further embodiment of the present invention described above that relates to clamping of the pourer in the bottle can, of course, be used independently of the previously described construction consisting of a first and second free extremity and rights are also claimed for embodiments with a free extremity of different construction and with the clamping/sealing mechanism described above.

The pourer described above can be produced from any material in any way known in the state of the art. However, this preferably consists of a plastic material that is produced by injection moulding. A completely transparent material such as polycarbonate is mentioned as an example of such a plastic material. When pouring liquids in which solids or other anomalous constituents can be present, this has the advantage that such abnormal products can easily be detected during pouring. Dregs in wine are mentioned as an example.

BRIEF DESCRIPTION OF THE DRAWINGS

The invention will be explained in more detail with reference to an illustrative embodiment shown in the drawing. In the drawing.

DETAILED DESCRIPTION OF THE INVENTION

Figure 1:
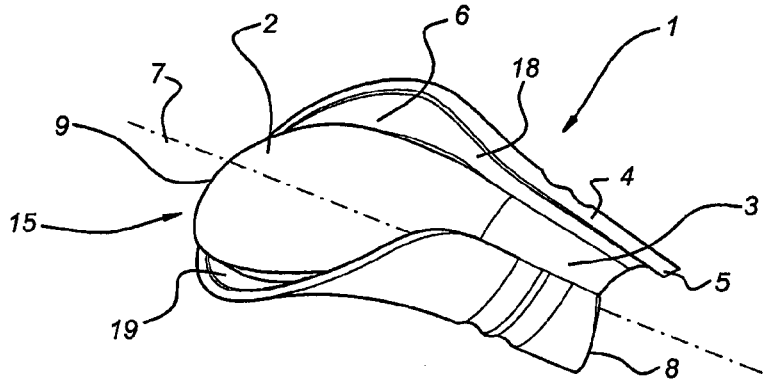
FIG. 1 shows a perspective view of the pourer according to the present invention.

In FIG. 1 the pourer according to the present invention is indicated in its entirety by 1. This pourer consists of a pouring section 2 at the one end 15 and a clamping section 3 at the other end. Clamping section 3 is designed to be fitted in the interior of a neck 11 of a bottle 10. The clamping section is provided with ribs 4 which extend around (parts of) an arc. It can be seen from FIG. 1 that the pourer is an essentially tubular body provided with a longitudinal gap 6. The longitudinal axis is indicated by 7.

The pourer consists of a resilient deformable plastic material. The presence of the gap makes the pourer compressible for introduction into the neck of a bottle. In the non-compressed position the external diameter of the clamping section 3 is approximately 20 mm.

This tubular body is not completely cylindrical in the non-compressed position but is flared to some extent from the clamping section 3 towards the pouring section 2. An angle of approximately 7° with respect to the longitudinal axis 7 is mentioned as an example. Optimum clamping can be obtained in this way.

The clamping section 3 terminates in a point 5 and from point 5 the end limit 8 of the clamping section 3 extends spirally with respect to longitudinal axis 7. In an advantageous embodiment the distance from point 5 to ribs 4 is approximately 15 mm.

Figure 2:
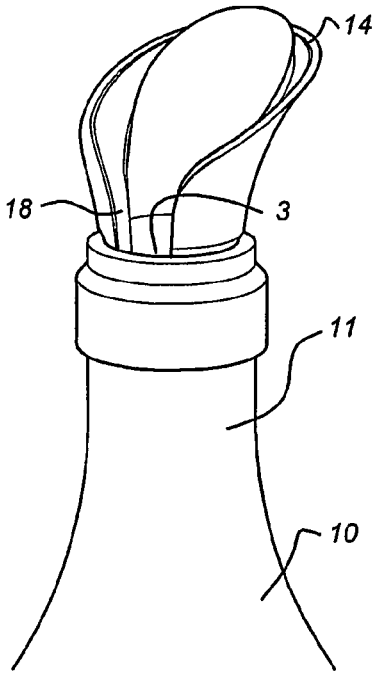
FIG. 2 shows the pourer according to the present invention fitted in a bottle.

The use of the pourer according to the invention fitted in a bottle 10 with neck 11 is shown in FIG. 2. Further details can be seen from FIG. 3. In the latter figure neck 11 is shown on an enlarged scale in cross-section. It can be seen that an increase 12 in the diameter is provided close to the free end of neck 11. The pourer according to the present invention is so constructed that it extends into the region of the expansion in the diameter when it is introduced. More particularly, a peripheral rib 4 extends therein in order to provide an optimum seal. As a result of the conical construction, close to point 5 the pourer 1 is some distance away from the bottle neck, that is to say makes no contact with the bottle neck at this location. As a result, when pouring out (gently), heavier material such as sediment or other solid material, will move into the space between part 5 and bottle neck 11 and after pouring will slide back into the bottle along the wall of the bottle.

Introduction of the pourer 1 according to the present invention into a bottle is relatively easy. Point 5 is introduced into the bottle neck and by pushing the pourer along longitudinal axis 7 in the longitudinal direction of the bottle the pourer is at it were automatically introduced into the interior of the bottle. During this operation the user clearly senses the engagement of the peripheral rib 4 on section 12 of enlarged diameter. As a result of the presence of the gap between the end limits of the pourer and as a result of the fact that the pourer is, moreover, preferably made of transparent material, the user is able to observe the flow of drink from the bottle particularly well, as a result of which pouring is optimised.

Figure 2A:
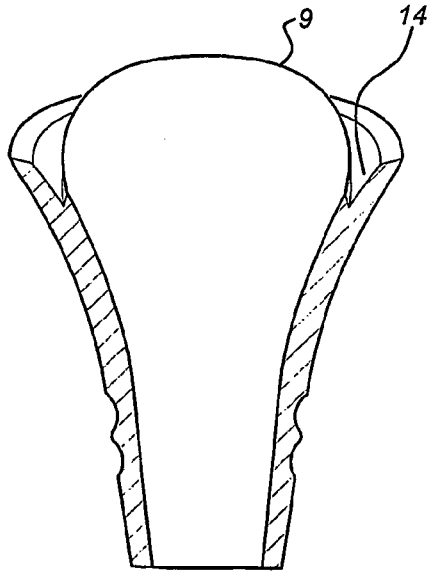
FIG. 2*a* shows a detail thereof.
Figure 3:
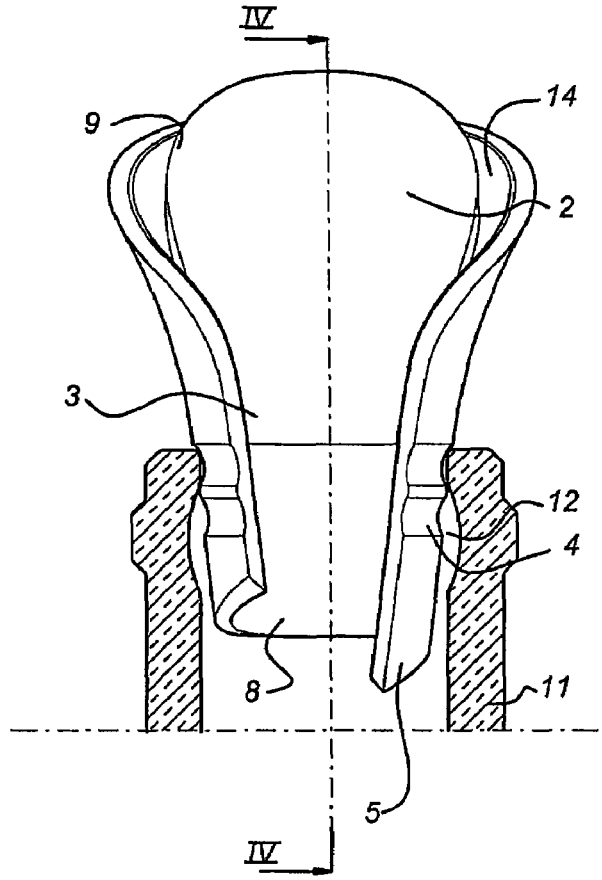
FIG. 3 shows a further view of the pourer.
Figure 4:
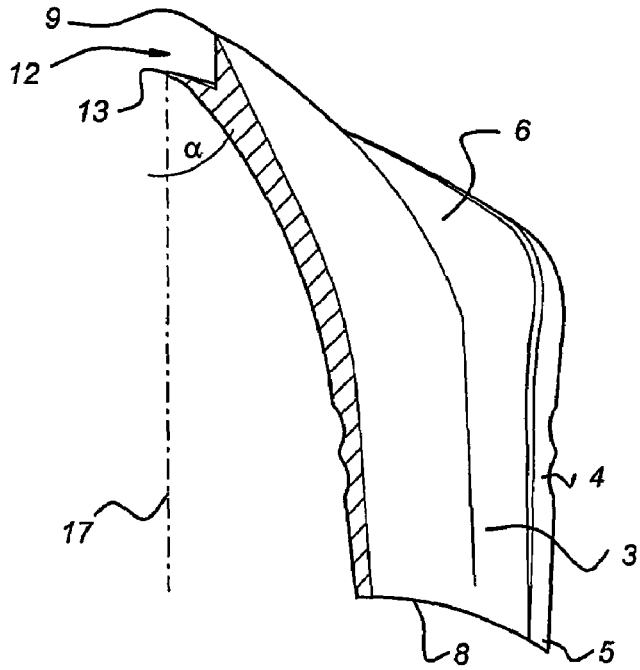
FIG. 4 shows a detail of FIG. 3 in cross-section.

Details of the pouring section 2 and the collector located beneath it can also be seen from FIGS. 3 and 4. There is a double pouring edge indicated by 12. This is made up of a first free extremity 9 and a second free extremity 13. Both are made sharp, that is to say counteract droplet formation as much as possible. In the pouring position the first free extremity 9 protrudes further than the second free extremity 13. There is a channel 14 between the first and second free extremity. This channel consists of a transverse section 19 that extends essentially perpendicularly to the longitudinal axis 7 of the pourer. This transverse section gradually merges on either side into two longitudinal channels 18 which, in turn, merge into the interior of the pourer. At the location of this transition, the channels are essentially parallel to the longitudinal axis 7. Should any droplets first pass over the free extremity 9 these then reach, during pouring, the region between the first free extremity 9 and second free extremity 13 in the transverse section of the channel 4. When the bottle is brought upright again such droplets run from the transverse section into the longitudinal section 18 of the channel 14 back into the bottle, as a result of which spillage is prevented as far as possible. Because channel 14 becomes smaller towards the bottom (FIGS. 2 and 3), any droplet will be drawn downwards by the capillary action. This reduction in size is achieved in that the height of the raised edge of the pouring section becomes increasingly lower from free extremity 9 to the interior of the pourer. The shape of the channel is shown in detail in FIG. 2*a*.

To enable optimum pouring, the first free extremity 9 is preferably constructed such that it protrudes further than the second free extremity 13. This, of course, applies for the pouring position. In this way it is possible to pour accurately and the second free extremity does not constitute an impediment when pouring.

With respect to the bottle, the pourer is flared relatively wide towards the pouring section 2. As a result accurately controlled pouring can take place and it is also possible after pouring to rotate the bottle to some extent to prevent dripping.

In FIG. 4 a line 17 parallel to axis 7 in FIG. 1 has been drawn. This line has been made such that it intersects point 13. Angle $\alpha$ according to the present invention is always positive. After all, this means that when the bottle or pourer is in the horizontal position a droplet located at the top of part 13 is never able to reach the region of the underside of part 13 (as seen in FIG. 4). Therefore, when the bottle is moved from the horizontal pouring position into the upright position again all liquid that may have leaked out will move back exclusively via channel 14 and not along the outside of the pourer.

It will be understood that the pouring edge described above can be used with any pourer according to the state of the art.

The material of the pourer can be any material known according to the state of the art. Preferably, however, this consists of a material that is repellent with respect to the substance to be dispensed, such as wine. As a result, as few residues as possible remain behind. This can be further improved by making the surface that comes into contact with drink as smooth as possible.

Figure 5:
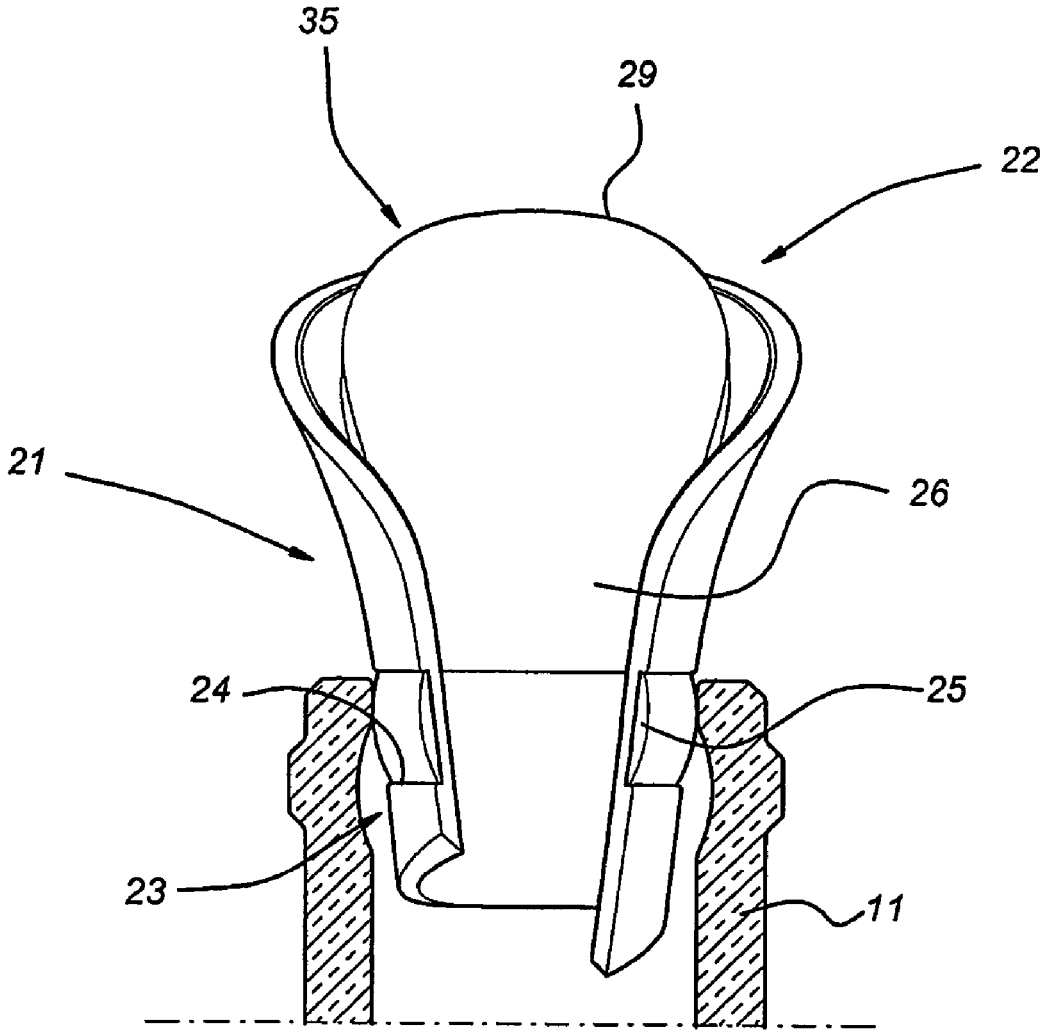
FIG. 5 shows a variant of the pourer according to the invention in cross-section.

A further variant of the invention, indicated in its entirety by 21, is shown in FIG. 5. This variant essentially corresponds to what has been shown in the preceding figures, that is to say consists of a pouring section 22 and a clamping section 23.

Instead of the ribs described above, the clamping section is provided with a groove 24 in, which an annular band of elastomer material 25 has been fitted. This fitting can take place after production of the pourer 21 but it is also possible to inject both the hard plastic for the pourer and the elastomer material for band 25 in a mould. The free free extremity of the pourer is indicated by 29, whilst 35 indicates the pouring/collection end.

In the case of this construction as well the pourer is split, that is to say does not extend around the full periphery. The band 25 is shaped correspondingly.

It can be seen from FIG. 5 that band 25 engages on the top part of the bottle so that a perfect seal can be guaranteed under all circumstances. As a result of deformation of the elastomer material on introduction into the bottle, both clamping and sealing are produced. As a result of the previously mentioned open section 26 it is still possible to achieve an optimum fit in a wide range of bottle diameters.

Although the invention has been described above with reference to a preferred embodiment, it will be understood that numerous modifications can be made without going beyond the scope of the appended claims.

For instance, it is possible to make the gap 6 narrower or to omit it completely, in which case the wall sections overlap one another. Furthermore, the insertion point can be made shorter or longer. Further measures can be taken to promote the flow of the liquid, with or without the introduction of air. These and further modifications lie within the scope of those skilled in the art after reading the appended claims.

The invention claimed is:

1. A pourer (1, 21) comprising:

a sleeve-shaped elongated body constructed at one end (3, 23) for clamping introduction into a pouring facility of a container and constructed at an other end (15, 35) as a collector for liquid droplets;

wherein a pouring section (2, 22) is arranged in said other end (15, 35), a free end (9, 29) of said pouring section in the pouring position protruding further than a free end (13) of the collector, wherein a collection channel (14) is delimited between said collector and said pouring section, said collection channel having a transverse section (19) extending transversely with respect to the longitudinal axis (7) of said elongated body and merging into a longitudinal section (18) on either side, wherein the longitudinal section (18) of the collection channel opens into the sleeve-shaped body, and wherein the cross-section of said channel gradually decreases from said transverse section to the opening of said longitudinal section into the sleeve-shaped body.

2. A pourer according to claim 1, wherein said collector and pouring section comprise a single material part.

3. A pourer according to claim 1, wherein the height of the pouring section (2, 22) protruding from the sleeve-shaped section decreases from the free end thereof towards the one end of the sleeve-shaped section.

4. A pourer according to claim 2, wherein an end limit of a second edge (13) is at an angle ($\alpha$) with respect to the longitudinal axis (17) of said pourer, which angle ($\alpha$) is positive.

5. A pourer according to claim 1, wherein the other end of said tubular body has an annular part provided with a split (6) extending in the longitudinal direction of said body over the entire length thereof, which annular part is made of a resilient material.

6. A pourer according to claim 5, wherein said split comprises a gap (6) of at least 20 degrees.

7. A pourer according to claim 5, wherein in the non-compressed position, the external diameter of the annular part is at least approximately 20 mm.

8. A pourer according to claim 5, wherein said annular part is provided with external ribs (4).

9. A pourer according to claim 7, wherein the annular part is provided with an elastomer sealing ring (25).

10. A pourer according to claim 5, wherein the free end of the annular part comprises a point (5) extending in the longitudinal direction.

11. A pourer according to claim 10, wherein from said point, said end limit of the annular part extends in accordance with a spiral, with the longitudinal direction as core.

12. A pourer according to claim 5, wherein said one part is flared after the free end.

13. A pourer according to claim 4, wherein said one end comprises part of a circle, wherein the arc spanned by said part of a circle decreases towards the free end.

14. A pourer according to claim 1, made from plastic material.

* * * * *